US006461148B1

(12) United States Patent
Scotto et al.

(10) Patent No.: US 6,461,148 B1
(45) Date of Patent: Oct. 8, 2002

(54) COMPACT, HIGH-TEMPERATURE, LOW-FLOW RATE, LIQUID FUEL-FIRED BURNER

(75) Inventors: Mark V. Scotto; Crispin L. DeBellis, both of North Canton; Edward D. Daum, Alliance, all of OH (US)

(73) Assignee: McDermott Technology, Inc., New Orleans, LA (US)

( * ) Notice: Subject to any disclaimer, the term of this patent is extended or adjusted under 35 U.S.C. 154(b) by 0 days.

(21) Appl. No.: 09/672,408

(22) Filed: Sep. 28, 2000

(51) Int. Cl.[7] ..... F23D 14/66

(52) U.S. Cl. ..... 431/215; 431/182; 431/166; 126/91 A; 432/180

(58) Field of Search ..... 431/158, 166, 431/215, 11, 187, 182, 188, 258; 432/180, 175; 126/91 A

(56) References Cited

U.S. PATENT DOCUMENTS

| | | | | |
|---|---|---|---|---|
| 3,212,554 A | * | 10/1965 | Blaha | 431/215 |
| 3,262,484 A | * | 7/1966 | Hess | 431/215 |
| 3,570,471 A | * | 3/1971 | Lazaridis | 126/91 A |
| 3,695,816 A | * | 10/1972 | Oeppen et al. | 431/215 |
| 4,401,099 A | * | 8/1983 | Collier | 431/215 |
| 5,505,615 A | * | 4/1996 | Witteveen | 431/182 |
| 5,833,450 A | * | 11/1998 | Wunning | 431/215 |

OTHER PUBLICATIONS

DeBellis, C.L., et al., "Conceptual Design of 500 Watt Portable Thermophotovoltaic Power Supply Using JP–8 Fuel," Technical Paper No. RDTPA 97–01 presented at the Third NREL Conference on Thermophotovoltaic Generation of Electricity, May 18–21, 1997, Colorado Springs, CO, USA.

DeBellis, C.L., et al., "Component Development for 500 Watt Diesel Fueled Portable Thermophotovoltaic (TPV) Power Supply," Technical Paper No. RDTPA 98–15 presented at the 4th NREL Thermophotovoltaic Generation of Electricity Conference, Oct. 11–14, 1998, Denver, CO, USA.

* cited by examiner

*Primary Examiner*—James C. Yeung
(74) *Attorney, Agent, or Firm*—Robert C. Baraona

(57) ABSTRACT

A burner, particularly for use in thermophotovoltaic (TPV) applications, is provided having a fuel distribution tube with integrated swirl vanes adjacent exit holes in the sides of the fuel distribution tube, a ceramic burner cap attached the top end of the fuel distribution tube and a liquid fuel being provided through a fuel feed tube protruding through the bottom end of the fuel distribution tube, thereby forming a burner assembly. The burner assembly fits slidably into a cylindrical burner sleeve which forces primary combustion air through a passage formed between the sleeve and the swirl vanes. The primary combustion air mixes with the fuel in the vanes and burner slot formed between the burner cap and sleeve. The fuel feed tube used to supply fuel to the burner is a heated tube having a small orifice at the burner end. The tube is heated using an internal heater that vaporizes the fuel and can also use recuperated heat from the burner combustion process. The fuel feed tube can include a cleaning needle and a thermocouple for determining the fuel temperature at the orifice for regulation of the heater.

Gaseous fuel would merely be introduced through an open-ended tube at the bottom of the fuel distribution tube.

16 Claims, 4 Drawing Sheets

COMPACT, HIGH-TEMPERATURE, LOW-FLOW RATE, LIQUID FUEL-FIRED BURNER

FIELD AND BACKGROUND OF THE INVENTION

The present invention relates generally to the field of power generation and in particular to a new and useful liquid fuel-fired burner for a thermophotovoltaic (TPV) system.

TPV electric generator systems operate by converting photons generated by an incandescent emitter into electric current. A basic TPV electric generator includes a burner which receives and burns a fuel. The incandescent emitter forms the boundary of the combustion region of the burner. The emitter is heated by combustion to incandescence, thereby emitting photons which are converted to electric current by adjacent photovoltaic cells. The photon's energy must exceed the bandgap energy of the photovoltaic cell to free an electron that can potentially contribute to an electric current. The bandgap energy is dependent on the type of photovoltaic cell, but typically it is in the near-infrared region of the electromagnetic spectrum. The current application uses GaSb photovoltaic cells which have a bandgap energy of 0.73 eV. The emitter temperature must exceed 2400° F. so that sufficient photons exceeding the bandgap energy are generated, thereby producing an energy efficient system with a high power density. Typically, a filter is provided to boost energy efficiency by reducing the amount of photons below the bandgap energy of the photovoltaic cells. In addition, excess heat energy contained in the combustion effluent is recycled to pre-heat combustion air and further improve the system efficiency. As a result, preheated air temperatures at the burner may exceed 1000° F.

Low-flow, diesel-fired burners have been developed commercially for a variety of heating applications. None of the known diesel-fired burners have the necessary geometry or are capable of withstanding a sufficiently high operating temperature for this TPV application. Further, no known burners can achieve the necessary rapid heat release and heat transfer required in this TPV application either.

SUMMARY OF THE INVENTION

It is an object of the present invention to provide a burner with high combustion efficiency and rapid energy transfer for use in a TPV system.

It is a further object of the invention to provide a burner which can operate using a variety of liquid and gaseous fuels.

Another object of the invention is to provide a burner that can withstand the very high operating temperatures found in TPV systems.

Accordingly, a compact, high-temperature, liquid fuel-fired burner is provided having a fuel distribution tube with at least one integrated swirl vane adjacent to at least one exit hole in the body of the distribution tube. The swirl vanes may be machined on the outer surface of the fuel distribution tube near the top end. A ceramic burner cap is connected to the upper end of the fuel distribution tube. A liquid or gaseous fuel is provided through a first fuel feed tube protruding through the distribution tube, thereby forming a burner assembly. The burner assembly fits into a burner sleeve which forces primary combustion air through a passage formed between the sleeve and the swirl vanes. A combustion chamber is connected to the burner above the burner cap and distribution tube.

An ignitor, that can be inserted through the sleeve, is used to initiate combustion of the fuel and air in a combustion chamber above the burner cap. The used combustion products are redirected down the outside of the combustion chamber and burner sleeve through a recuperator inlet. The combustion products may then be processed in a connected recuperator, if desired.

The first fuel feed tube has a small orifice at the burner end and means for vaporizing the fuel. Preferably, the tube may be heated using an internal heater that vaporizes the fuel. Alternatively, a start-up heat energy source may be used in conjunction with a control means for balancing and achieving a steady state of operation between the start-up heat energy and energy recuperated within the burner. Preferably, the start-up heat energy source is an internal heater within the burner structure. Additionally or Alternatively, the means for vaporizing the fuel may comprise a second feed tube adjacent the first feed tube and a pilot flame which may be controlled such that, once sufficient energy is recuperated, the burner may operate in a steady state.

Further, the first feed tube may surround the vaporization means so as to form a helical path connected the fuel supply. This set up may also incorporate a means for determining the temperature of the fuel, such as a thermocouple, to permit variable control of the vaporization means.

The fuel feed tube can include a cleaning needle and/or a thermocouple for determining the fuel temperature at the orifice for regulation of the heater. A temperature sensor may also be employed. Further, the burner sleeve may be slidably coupled to the distribution tube so as to allow variable control of the size of the annular passage.

The burner cap, the fuel distribution tube, and swirl vanes may be machined from a single article, preferably comprising either high-temperature metallic alloy or a ceramic.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
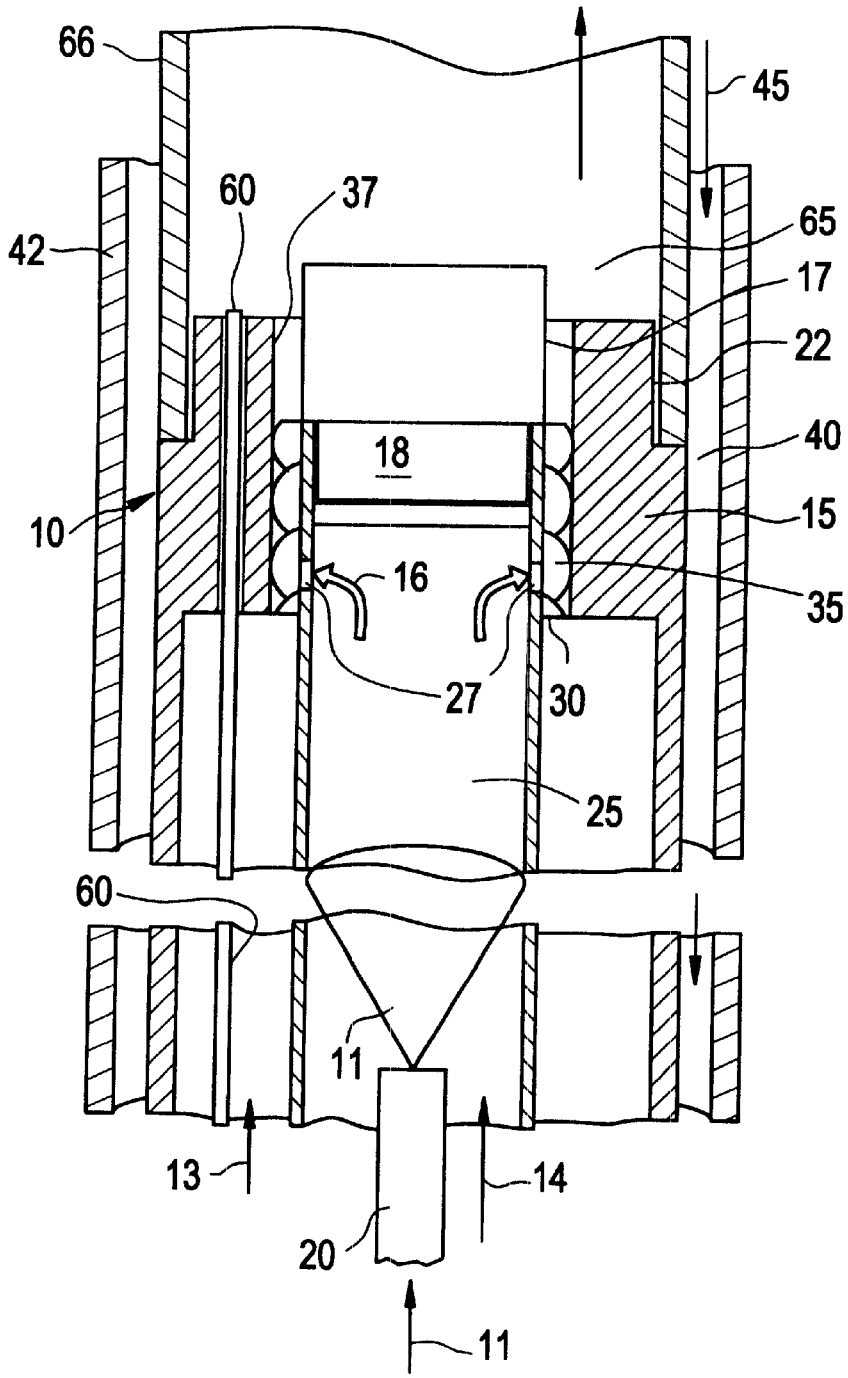
FIG. 1 is a sectional front elevational view of a burner according to the invention.

Referring now to the drawings, in which like reference numerals are used to refer to the same or similar elements, FIG. 1 shows a cylindrical burner 10 having a fuel feed tube 20 inserted into fuel distribution tube 25 at one end and having a ceramic burner cap 17 connected to the other end of the distribution tube 25. Swirl vanes 35 are provided on the outside of the distribution tube 25. The swirl vanes 35 are integral with the distribution tube 25 and may be machined on the tube 25 or connected in other known ways. Exit holes 27 are provided through the distribution tube 25 walls in the region of the swirl vane 35. At least one hole is provided for each swirl vane channel to ensure uniform mixing.

The distribution tube 25 and swirl vanes 35 slidably fit within a burner sleeve 15 of the burner 10 The burner sleeve 15 forms a channel with the outer surface of the distribution tube 25 and burner cap 17. The channel is comprised of the swirl vanes 35 at the lower end and a burner slot 37 at the upper end adjacent the combustion chamber 66. The combustion chamber 66 is a cylindrical volume above the burner cap 17. An ignition zone 65 is formed around the burner cap 17 and burner slot 37. An outer tube 42 forms an annular space with the outside of the burner sleeve 15 and combustion chamber 66 and forms the combustion side recuperator starting at the inlet 40 adjacent to the burner sleeve.

In operation, fuel 11 is provided through fuel feed tube 20 and enters distribution tube 25 in a vaporized state. The vaporized fuel may be mixed with premix air 14 supplied to the distribution tube 25 around the fuel feed tube 20. The fuel and air mixture 16 passes through exit holes 27 into the channels formed by swirl vanes 35 where it mixes with primary combustion air 13 which has been heated by a recuperator (upper portion shown). The primary combustion air 13 enters the burner 10 through air-side recuperator outlet 30 formed around the distribution tube 25 and passes into the swirl vanes 35 for mixing.

A high amount of air swirl is achieved when the swirl vane 35 is positioned at an angle between 45° and 75° relative to the longitudinal axis of the burner. A preferred metallic vane geometry includes a vane angle of 60° wherein six vanes are machined into the distribution tube 25 surface on a one inch span of the tube length. The preferred arrangement ceramic vanes would be limited to 4 channels due to limitations inherent in machining these materials. The swirl vanes 35 are positioned immediately adjacent the connection between the ceramic burner cap 17 on the end of the distribution tube 25.

The fuel and primary air mixture exit the burner slot 37, where they are ignited by ignitor 60. The combustion products are used for the particular application where the burner is being applied, such as in a TPV electric generator. The waste combustion products and heat can be passed through the annular recuperator inlet 40 and used to preheat the primary combustion air 13 entering the burner 10 through the air-side recuperator outlet 30, as is a preferred embodiment for the TPV application of the present invention.

The burner 10 components are all made of high-temperature resistant alloys. Burner cap 17 is preferably composed of high temperature ceramic and is secured to the end of the distribution tube 25 using a ceramic epoxy on a metallic pin 18 or other means known to those skilled in the art. The burner cap 17 has the same outside diameter as the distribution tube 25. An alternate embodiment would be to machine the burner cap, swirl vanes, and fuel distribution tube from a single ceramic or metallic article. A ceramic piece may be necessary in the hottest TPV application or if the alternative start-up method is applied. Metallic alloys would simplify fabrication for lower temperature applications.

The fuel distribution tube 25 uniformly distributes fuel 11 to the swirl vanes 35 through the exit holes 27. Preferably, at least one hole feeds each swirl vane channel to ensure uniform mixing. The amount of premix air 14 combined with the fuel 11 in mixture 16 is between 0 and 20% of the stoichiometric combustion air. The quantity of premix air 14 is controlled by the relative pressure differential across the primary and premix air paths. The pressure differential across the premix air flow path will be effected by the placement and total flow area of the exit holes 27 on the end of the fuel distribution tube 25. The number and size of the exit holes 27 determines flow area, while placement at the lower end of the swirl vanes 35 increases flow resistance over higher placements. Further, the premix air feed may include a variable flow resistance device, such as a multiple position valve (not shown).

Figure 2:
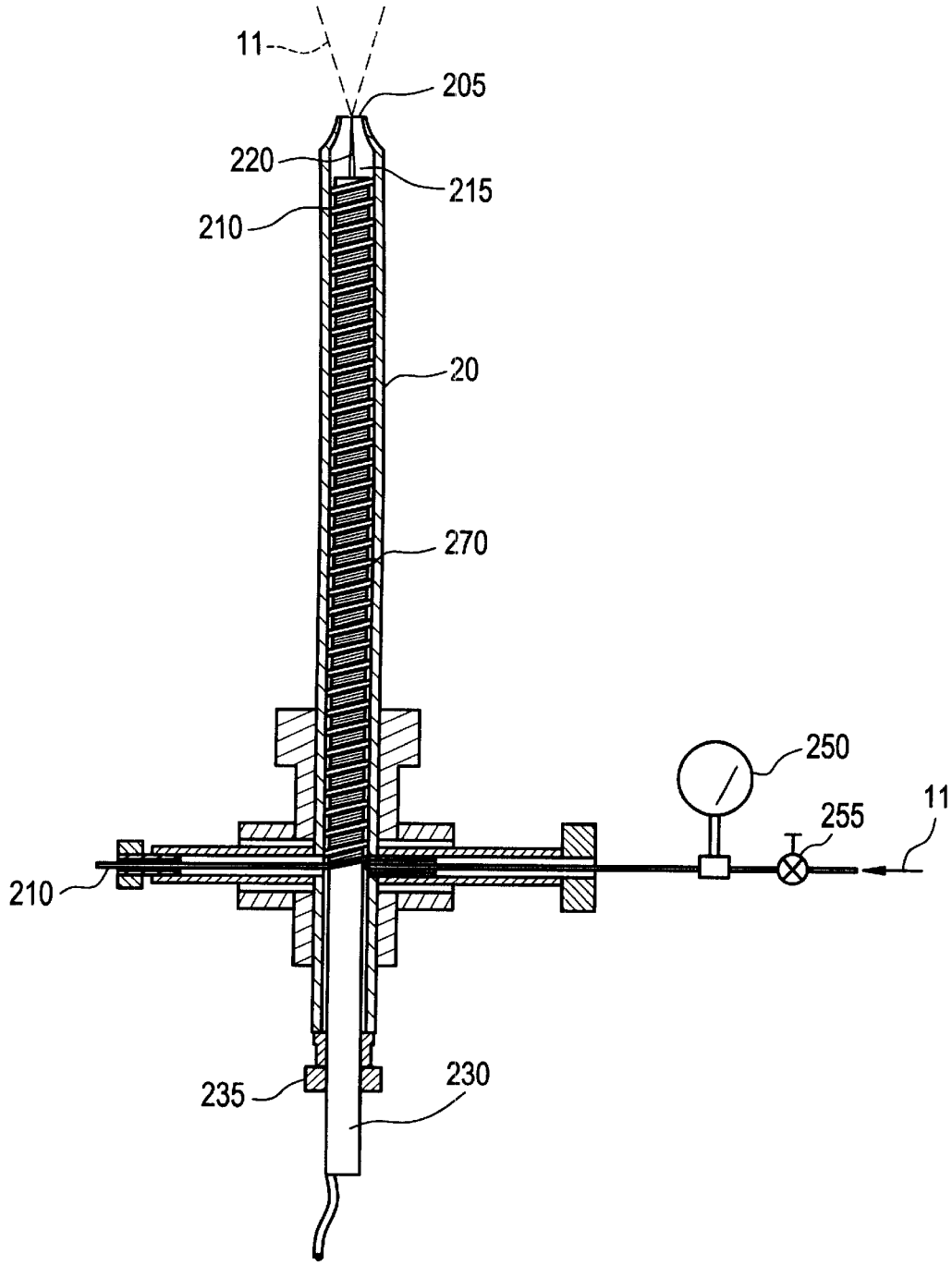
FIG. 2 is a sectional front elevational view of a fuel feed tube made in accordance with the invention.

FIG. 2 shows a fuel feed tube 20 used with the burner 10. An orifice 205 is provided at the outlet end of the feed tube 20 for distributing fuel 11 into the burner 10 of FIG. 1. A movable heater 230 extends through the interior of the fuel feed tube 20 and forms an annular space 270 with the inside wall of the fuel feed tube 20. The heater 230 is axially slidable within the fuel feed tube 20 through packing seal 235 at the lower end. A cleaning needle 220 is attached to the upper end of the heater 230 which can be moved through the orifice 205 to remove deposits and prevent blockage. The heater 230 may be turned down or turned off in applications where sufficient energy is recuperated from the combustion process to vaporize the fuel during steady state operation. Notably, steady state operation is fairly typical for TPV applications.

A wire 210, which may be a thermocouple, is spirally wound around the heater 230 from adjacent the lower end to the upper end of the heater 230 near the orifice 205. The wire 210 fills the space between the heater 230 and interior wall of the feed tube 20 thereby creating a spiral path in the annular space 270 for the fuel 11. When the wire 210 is a thermocouple, a fuel vapor temperature sensor 215 can be positioned at the top end of the heater near the orifice 205. The thermocouple measurement can subsequently be used to control the heater power.

The wound wire 210 causes fuel 11 entering the fuel feed tube 20 from the lower end to move up the feed tube 20 in the annular space 270 between winds of the wire 210, thereby increasing the velocity of the fuel over the heater 230 and resulting in better vaporization during start-up conditions. Once the burner 10 is operating at steady state, the recuperated heat transferred from the hot recuperator walls from premix air 14 can be used to heat and vaporize the fuel 11, as shown by FIG. 1. The fuel feed tube 20 must be inserted to a minimum depth to recover sufficient heat from the premix air 14 to vaporize the fuel 11.

Fuel 11 flow may be varied by use of a valve 255 and pressure gauge 250 positioned on the inlet line to the fuel feed tube 20. Alternatively, fuel flow may be varied by increasing or decreasing the speed of a variable speed pump that delivers fuel to the system.

The burner 10 and fuel feed tube 20 of the invention permit the use of heavier liquid fuels, including diesel, in particular due to the presence of the cleaning needle 220 and heating element 230. The burner 10 can also be used to fire gaseous fuels through a simple open ended feed tube (not shown).

The burner 10 maximizes the heat release rate and the heat transfer rate near the burner 10 by using high air swirl and partial premixing of vaporized fuel and air. The premixing significantly increases heat-release rates by lessening the mixing limitation after ignition on the rate of combustion and eliminating an ignition-delay. The benefit of enhanced mixing from high air swirl exists because the vaporized fuel and air are not completely premixed. Premixing is achieved using rapidly moving premix air in the swirl vanes 35 and burner slot 37, and as well, by the small quantity of premix air 14 in the fuel distribution tube 25 when premix air is used to facilitate fuel vapor transport and mixing.

High air swirl yields the desired flame characteristics by increased mixing from increased local velocity shear (turbulence), and intense flow re-circulation. Re-circulation will also transport hot products of combustion back toward the flame to regions of relatively low local velocities, thus establishing a stable ignition zone. Furthermore, the high air swirl propels the flame almost directly toward the lower side walls of the combustion chamber 66, significantly increasing the rate of convective-heat transfer.

Rapid premix is defined as intense mixing of fuel vapor and air just upstream of the burner outlet in the swirl vanes 35 and the burner slot 37. Fluid residence times in the rapid premix region are on the order of milliseconds. The velocities are high enough to prevent ignition upstream of the burner. High-velocity rapid premix allows very hot preheated combustion air to become mixed with fuel vapor without significant fuel oxidation or ignition occurring upstream of the burner.

Rapid premixing may be enhanced by the additional mixing of the fuel with a small quantity of premix air 14 diverted through the fuel distribution tube 25. The premix air 14 significantly increases the volumetric flow of the fuel-rich vapor, and thus, the mixing rate (turbulence) with the primary combustion air 13 in the swirl vanes 35 is increased. In addition, the premix air 14 gives the mixing a head start, but must be held below the flammability limit to prevent early ignition in the fuel distribution tube 25. Rapid premix significantly increases heat-release rates by lessening the mixing limitation after ignition on the rate of combustion.

The fuel distribution tube 25 uniformly distributes the fuel to each swirl vane 35, and thus, enhances flame symmetry about the burner axis. The premix air 14 enhances flame symmetry by increasing mixing and turbulence in the fuel distribution tube 25 prior to the fuel 11 entering the exit ports 27.

The fuel feed tube 20 vaporizes the fuel 11 under moderate pressure. The pressure is sufficient to attain sonic velocity in the orifice 205, the maximum attainable velocity. The flow stays fixed at the sonic velocity when the feed pressure divided by the fuel distribution tube pressure is equal to or greater than the critical pressure ratio. Therefore, fuel-feed fluctuations in the feed tube 20 are dampened out at the orifice 205, and a relatively stable feed is achieved.

The use of a ceramic burner cap 17 protects the metallic burner components (i.e. swirl vanes 35) from the high temperature flame environment. The cap 17 achieves this by shielding metal components from direct exposure to the radiant heat flux, and also by insulating the burner 10. The thermal conductivity of the ceramic is much less than the metal components. The cap 17 extends into the combustion cavity 66. This prevents re-circulation to the burner face, and prevents the carbon build-up observed at the burner face during early testing without the cap 17 in place. Finally, the cap 17 promotes ignition by providing a very hot surface with some flow re-circulation occurring about the top of the cap 17.

Figure 3:
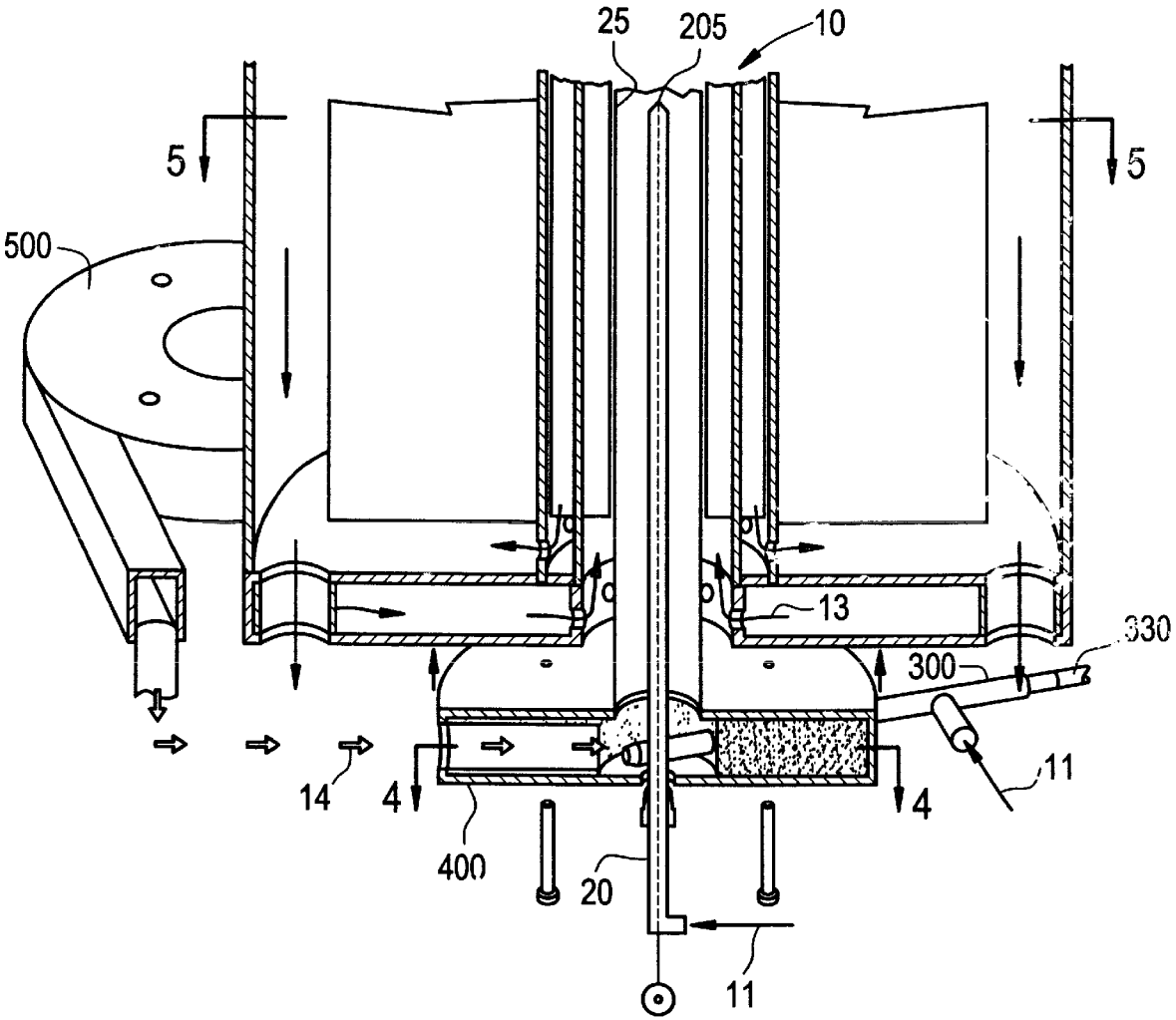
FIG. 3 is a sectional front perspective view of a burner start-up configuration for use in a TPV application.
Figure 4:
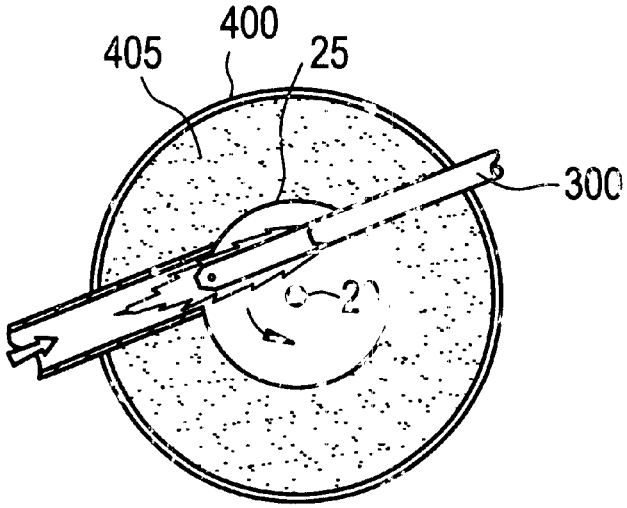
FIG. 4 is a sectional top plan view taken along line 4—4 of FIG. 3.
Figure 5:
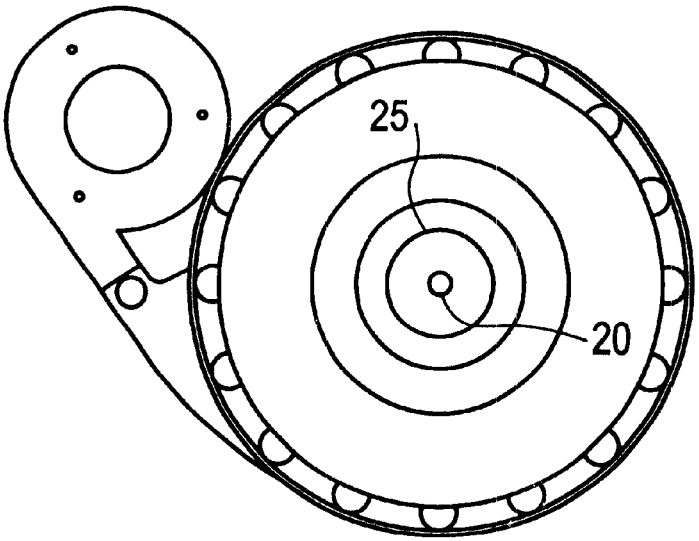
FIG. 5 is a sectional top plan view taken along line 5—5 of FIG. 3.

FIGS. 3–5 illustrate an alternative embodiment for start-up operation of the fuel feed tube 20 and burner 10 which can be used for TPV applications. These alternatives avoid use of a heater and, for complete shutdown at steady state, rely on the intense recuperation achieved by a TPV system. This recuperation should be sufficient to vaporize all fuel(s) for this alternative to operate most effectively. These alternatives may also be used continuously at steady state for other applications which do not recuperate sufficient energy from the combustion products to vaporize fuel in the primary fuel feed tube. Additionally or alternatively, the energy generated by the alternative embodiment described in this paragraph may be reduced to balance the recuperated energy, thereby providing another means for vaporizing all of the fuel.

Heat energy recovered through a recuperator can be used to vaporize the fuel 11 during steady state operation in a TPV application. However, this energy is not available at burner start-up.

Start-up strategies are developed to minimize the amount of stored power necessary to bring the system up to steady state operation. The heater 230 in the fuel-feed tube 20 of FIG. 2 requires a significant quantity of start-up power to vaporize the fuel 11 for the period of time before sufficient heat is recovered from a TPV recuperator to operate without the heater 230. The power storage requirements may require a battery that is too large and heavy to be practical for such a device.

In FIGS. 3–5, a start-up fuel vaporization heater 330 supplies energy to a second much smaller fuel-feed tube 300 that produces a pilot flame that engulfs the primary fuel-feed tube 20. The start-up vaporization heater 330 requires significantly less power to vaporize the smaller quantity of fuel 11 supplied to the pilot flame. In addition, the fuel flow to the pilot flame will be decreased as heat that is absorbed by the primary fuel-feed tube 20 through the recuperator increases. Therefore, power to the start-up vaporization heater 330 can be reduced as this occurs.

Furthermore, the pilot flame immediately heats the pilot flame's fuel-feed tube 300, allowing a faster reduction in parasitic power supplied to the heater 330. In some applications, sufficient heat is internally absorbed through the recuperator at steady state to vaporize all the fuel 11 in the primary fuel-feed tube 20. Under these circumstance, at steady state, the pilot flame will be off and a small portion of the combustion air 13 may replace vitiated air to transport the vaporized fuel from the primary fuel-feed tube 20 to the main ignition zone of the burner 10.

The pilot flame may be contained within a heating chamber 400 surrounded by insulation 405. The heating chamber may be mounted to the bottom of the burner 10. A fan 500 for supplying combustion air 13, 14 to the pilot flame and burner can be provided as well and attached by ducts or in another known manner.

The potential advantages to these alternative embodiments are numerous. Start-up for this concept should be very easy and reliable relative to the previous start-up concept (using the heater 230 described above). A fuel distribution tube for mixing the vaporized fuel emanating from the primary fuel-feed tube with cold premix air at start-up is provided. However, this tube will cause significant re-condensation of the fuel, potentially making ignition difficult. Thus, in the alternative concept, the fuel distribution tube's air would initially feed the small pilot flame that directly heats the primary fuel generator. As a result, the hot gases from the pilot flame would not only vaporize the fuel in the primary (steady state) fuel-feed tube, but also provide a hot gas to transport the vaporized fuel to the primary burner's ignition zone, preventing re-condensation. In addition, a relatively low parasitic power consumption would be necessary to vaporize the pilot's relatively small fuel supply and to ignite the hot gaseous and combustible mixture at both the pilot and main flame with a very small (i.e., low energy) spark igniter. The parasitic power requirement for the fuel vaporization would be more quickly shut down in this alternative because the primary fuel internally absorbs system heat more rapidly due to the supplemental fuel added with the pilot. Finally, the pilot flame would feed energy back to the pilot's fuel-feed tube, thereby allowing power to the start-up heater to be more quickly reduced.

A still further embodiment of the present invention would provide for machining the burner cap, swirl vanes, and fuel distribution tube from a single article, preferably a ceramic or high-temperature metallic alloy. A ceramic piece may be necessary in the hottest TPV applications or if the alternative start-up method (described above) is applied.

Some vendors have developed the capability to make the burner by machining ceramics in the "green state." However, green state machined articles typically have only four vanes because six vanes require dimensions that are too small to ensure sufficient structural integrity when made from the ceramic SiC. The alternative start-up method (described above) may also warrant a fuel distribution tube that is entirely made from other high temperature materials. Such a single metallic piece would simplify fabrication for lower temperature applications.

While a specific embodiment of the invention has been shown and described in detail to illustrate the application of the principles of the invention, it will be understood that the invention may be embodied otherwise without departing from such principles.

We claim:

1. A compact, high-temperature, liquid fuel-fired burner comprising:

a fuel distribution tube having a body, an upper end, at least one integral swirl vane adjacent to the upper end of the distribution tube, and at least one exit hole through the body of the distribution tube adjacent to at least one swirl vane;

a burner cap connected to the upper end of the distribution tube;

a first fuel feed tube having a body, an upper end, an orifice located at the upper end of the first feed tube and means for vaporizing a liquid fuel supplied through the body of the first feed tube and the first feed tube being positioned so that the orifice is located within the distribution tube;

a burner sleeve having an annular burner slot, and the burner sleeve surrounding the distribution tube with at least a portion of the burner cap forming an annular passage through the swirl vanes and the annular burner slot between the burner sleeve and portion of the burner cap; and a combustion chamber connected to the burner sleeve above the burner cap and the distribution tube.

2. A burner according to claim 1, wherein the burner cap is a high-temperature ceramic.

3. A burner according to claim 1, wherein the means for vaporizing a liquid fuel comprises an internal heater.

4. A burner according to claim 1, wherein the means for vaporizing a liquid fuel comprises: a start-up heat energy source and control means for balancing and achieving a steady state of operation between the start-up heat energy and energy recuperated within the burner.

5. A burner according to claim 1, wherein the means for vaporizing a liquid fuel comprises a second feed tube adjacent to the orifice of the first feed tube and a pilot flame located within the second feed tube, the pilot flame having means for controlling the flame until sufficient energy is recuperated to achieve a steady state operation of the burner.

6. A burner according to claim 1, wherein the body of the first feed tube surrounds the means for vaporizing a liquid fuel; wherein the first feed tube is positioned to form a heating annulus having a spirally wound wire defining a helical path through the heating annulus; and wherein the helical path fluidically connects the orifice to a fuel supply.

7. A burner according to claim 6, wherein the spirally wound wire further comprises means for determining the temperature of the fuel at the orifice so as to permit variable control of the means for vaporizing a liquid fuel.

8. A burner according to claim 7, wherein the means for determining the temperature of the fuel at the orifice comprises a thermocouple.

9. A burner according to claim 1, wherein the first feed tube further comprises a cleaning needle.

10. A burner according to claim 1, wherein the burner sleeve is slidably coupled to the distribution tube so as to allow variable control of the size of the annular passage.

11. A burner according to claim 1, wherein the first feed tube further comprises means for determining the temperature of the fuel at the orifice so as to permit variable control of the means for vaporizing a liquid fuel.

12. A burner according to claim 11, wherein the means for determining the temperature of the fuel at the orifice comprises a thermocouple.

13. A burner according to claim 12, wherein the means for determining the temperature of the fuel at the orifice further comprises a temperature sensor.

14. A burner according to claim 1, wherein the burner cap, the swirl vanes, and the distribution tube are machined from a single article.

15. A burner according to claim 14, wherein the single article consists of one of: a ceramic and a high temperature metallic alloy.

16. A burner according to claim 4, wherein the start-up heat energy source comprises an internal heater.

* * * * *